US005178398A

United States Patent [19]

Eddy

[11] Patent Number: 5,178,398

[45] Date of Patent: Jan. 12, 1993

[54] HUNTING BROADHEAD FOR ARROWS

[76] Inventor: Byron C. Eddy, 10441 Calle Trece, Tucson, Ariz. 85748

[21] Appl. No.: 767,429

[22] Filed: Sep. 30, 1991

[51] Int. Cl.[5] ..... F24B 6/08

[52] U.S. Cl. ..... 273/421

[58] Field of Search ..... 273/419–422

[56] References Cited

U.S. PATENT DOCUMENTS

| | | | |
|---|---|---|---|
| 2,568,417 | 9/1951 | Steinbacher | 273/421 |
| 2,820,634 | 1/1958 | Vance | 273/421 |
| 3,014,305 | 12/1961 | Yurchich | 273/419 |
| 3,168,313 | 2/1965 | Lint | 273/419 |
| 3,578,328 | 5/1971 | Rickey | 273/421 |
| 3,600,835 | 8/1971 | Hendricks | 273/421 |
| 3,738,657 | 6/1973 | Cox | 273/421 |
| 4,099,720 | 7/1978 | Zeren | 273/422 |
| 4,166,619 | 9/1979 | Bergmann | 273/421 |
| 4,615,529 | 10/1986 | Vocal | 273/421 |
| 4,976,443 | 12/1990 | De Lucia | 273/421 |
| 5,046,744 | 9/1991 | Eddy | 273/421 |
| 5,078,407 | 1/1992 | Carlston et al. | 273/421 |

*Primary Examiner*—Paul E. Shapiro

*Attorney, Agent, or Firm*—J. Michael McClanahan

[57] ABSTRACT

A hunting broadhead for attachment to an arrow used in bow hunting of a game animal having two thin flat metal elongated blades juxtaposed each other pivotally secured in a slot situated in a rearwardly located tubular body. Each blade has a pointed first end adapted to precede the arrow in flight for penetration of the animal's hide and initial movement into the animal. Each blade has one sharpened lengthwise side and one blunted side with the outstanding spur, the blunted sides extending outwardly of the sharpened sides when the pointed front ends overlap permitting an elastic band to encompass both said blades to maintain such configuration for flight and initial penetration of the animal. After penetration into the game animal, rearwardly located outwardly protruding spurs engage the animal's hide causing a metamorphosis whereupon the blades rotate with the rear moving to the front to become the forward leading point. After rotation, the sharpened blades become the leading members of the wide "V" configuration for continued movement through the animal to effect a clean kill.

13 Claims, 1 Drawing Sheet

HUNTING BROADHEAD FOR ARROWS

BACKGROUND OF THE INVENTION

1. Field of the Invention.

The field of the invention is broadheads or points (also called arrowheads) for arrow shafts used with a bow for hunting. More particularly, the field involved concerns broadheads which assume one configuration during flight and a second configuration after it strikes the target, such as to more efficiently accomplish its function of humanely disabling and killing the game animal.

2. Description of the Related Art.

In recent years there has been significant advances in the art of broadheads for hunting arrows designed to cause the animal to cease its travel by more effectively disabling and killing the animal being hunted and while doing so, reduce suffering by the animal.

Other inventions include the arrowhead assembly by Vance in U.S. Pat. No. 2,820,634 where two blades pivotably mounted to the head of the arrow shaft, when striking the side of the animal, immediately begin to rotate past each other to a expanded "V" configuration. The blades are initially joined in a somewhat pointed orientation. It is noted that the sharpened edge which is presented in the initial orientation remains the sharpened edge in the final opened "V" configuration.

The patent of Vance is modified somewhat in Rickey, U.S. Pat. No. 3,578,328, where in a similar construction, the arrow shaft body continues beyond the front point of the two pivotable blades to form a front piercing point. The two blades, like those in Vance, rotate past each other when rotational movement is forced upon the blades by the blades engaging the hide of the animal. A same sharpened edge which engages the animal initially is the forward sharpened edge as the arrowhead proceeds through the body of the game animal.

Lastly, Steinbacher in U.S. Pat. No. 2,568,417 adopts the forward point of an arrow shaft as the leading point and secures rotatable blades within the arrow shaft forward point. The blades are rotated outwardly not crossing each other as outstanding flanges on the blades engage the animal after initial penetration by the forward point portion. Other U.S. patents which show features similar to the features described above but constructed in a different manner include Bergmann, U.S. Pat. Nos. 4,166,619; Vocal, 4,615,529; Cox, 3,738,657; and Hendricks, 3,600,835.

All of the above prior art patents are characterized by arrowpoint bodies which have protruding spurs or cutting blades extending outwardly from its sides, some extending prior to the arrowpoint entering the body of the animal and some extending after the arrowpoint has entered the body of the animal. The extending blades or spurs appear to accomplish their function very efficiently, i.e., that of cutting as wide a swath as possible in order to bring the game down.

All of the arrowheads or points illustrated above employ a cylindrical pointed arrowhead body (with the exception of Vocal and Vance) with the spurs or blades emerging from the body, either being pivotable near the head of the body or at the rear of the body, some pivoting upon entering the body of the animal and some pivoting after entry into the body of the animal. This, of course, is not without reason since for the arrow to travel through to its target with minimum air resistance, it is generally necessary that the smallest point cross-section as possible be utilized. However, the cylindrical body portion of the arrow point itself is relatively inefficient as it contributes very little to the end results of the arrowhead.

Thus, the relative efficiency of the arrowhead or point may well be improved if the whole point itself comprises the blades which ultimately rotate outwardly. Vance does present an arrowhead assembly wherein the cutting blades also comprise the forward point, however, the blades are so arranged that they commence rotation and open to the widest possible configuration immediately upon hitting the hide of the animal and thus suffer the possibility of not only dulling on the animal hide, especially if the animal has dried mud or dirt on its side, which is highly likely, but also being forced to engage a heavy hide in the open position on initial penetration and thereby wasting considerable energy. In addition, since the sharpened edges are always exposed, a safety hazard is always presented to the hunter in handling the arrowhead prior to use.

It is also apparent that an obvious improvement to the state of the art exists if the rather small point on the arrow shaft necessary for guiding the arrow to it's mark should, upon striking the animal, metamorphosis entirely into outstanding cutting blades which bring down the game more efficiently.

It is also apparent that an obvious improvement exists if the sharpened edges can be protected against dulling or operator injury prior to the arrowhead entering the body of the game animal. Further it would also be a considerable improvement if both blades could be locked together during initial penetration until the heavy hide and ribs have been penetrated.

SUMMARY OF THE INVENTION

The embodiment of the invention described consists of two blades pivotably mounted to a rearward located cylindrical body, the cylindrical body adapted to be attached to one end of an arrow shaft. More specifically, the two blades, which are identical in construction, are so constructed as to form a pointed first forward penetrating portion of the hunting broadhead (well before the cylindrical body touches the game hide). As the hunting broadhead enters the body of the animal, outstanding spurs attached to the blades and situated rearward of the forward section of the blades are engaged by the animal hide or bones (ribs) on contact to cause the blades to pivotally separate to form an inverted "V" configuration, all within the body cavity of the animal. At that time, the hunting broadhead has gone through a complete metamorphosis from a relatively sharp and narrow pointed hunting broadhead for initial penetration to a very wide broadhead that relies entirely upon the extending blades for cutting while penetrating. Further, the cylindrical body never is the predecessor of the blades.

My first hunting point, (U.S. Pat. No. 5,046,744 issued Sep. 10, 1991) depended upon friction between two blades to keep the blades positioned together to form the narrow sharpened hunting point which was maintained during storage of the hunting point, handling by the operator, and initial flight from the bow to the animal. Further, my first hunting point also depended upon one angled side of each of the blades of the sharpened front edge of the point engaging the animal to keep the blades together after initial penetration until the rearwardly located outstanding spurs engage the animal's hide and bones.

In my present invention, I utilize a rubber band situated at some point in front of the outstanding spur on each blade (later discussed) as well as side pressure created by contact to exposed edges anterior to the spurs to keep the blades together.

Each blade is an elongated thin piece of metal having a combination of partially sharpened edges, blunted partially chamferred edges, and square cut edges (edges unmodified after the blade is stamped or cut out of flat stock). At a first or forward end is a point (formed from two angled partially chamferred edges), with a first side joining one of the partially chamferred edges of the pointed first end, said first side having a long, slightly curved, sharpened cutting edge which extends to the opposite second or rear end where it terminates in a substantially right angle foot, the edges making up the right angle foot also being sharpened.

Along the second side joining the other partially chamferred edge making up the pointed first forward end is a substantially straight partially chamferred angled edge extending approximately 60 percent of the length of the blade, this partially chamferred edge terminating into an outwardly protruding spur, which spur also has a partially chamferred edge on its forward portion. The rubber band previously discussed is preferably retained at the intersection of the substantially straight partially chamferred edge and the outwardly protruding spur edge.

Proceeding rearward from the outwardly protruding spur, the falling edge of the blade is square cut (having neither a sharpened edge nor a partially chamferred edge), and retreats toward the first side at an angle to form a second stop until it reaches the vicinity of the opening formed in each blade to accommodate a pivot pin. Surrounding that opening is a semi-circular outwardly directed protrusion. Lastly, the semi-circular protrusion accommodating the pivot pin opening then joins with a short straight square cut edge to form a first stop which terminates at the right angle foot. This first stop is urged against the side of the cylindrical body by the rubber band to define the position of each blade forming the pointed configuration.

Receiving two blades in a back-to-back configuration is an elongated cylindrical body having at a first end a chamferred rounded edge (not necessarily forming a point although it could) and at the opposite end, male threads to be received in female threads at the end of an arrow shaft, or any other arrangement to attach to the end of an arrow shaft. At the first end of the cylindrical body is a lengthwise elongated slot, the slot adapted to receive the two identical blades of the invention. Transversely to the elongated slot and on opposite sides are openings to secure the previously mentioned pivot pin. This pivot pin resides in the opening of each of the two blades making up one complete hunting broadhead.

When the hunting broadhead is assembled, the blades are positioned so that their back surfaces, which are completely flat not having the formed sharpened edges or partially chamferred edges, are placed juxtaposed each other. By this means, the surfaces making up the sharpened edges and partially chamferred edges of each blade will be on the outside and never hidden by the opposite blade. The hunting broadhead is assembled by aligning each of the blade's opening over the opening in the cylindrical body and then inserting the pivot pin into the opening on one side of the cylindrical body, through each of the openings in each of the blades, and into the opening on the other side of the cylindrical body so that the pivot pin completely crosses the elongated slot. The diameters of the openings in the cylindrical body and the pivot pin are very close to each other so that there is a tight frictional holding relationship between the two such as to keep the pivot pin in place once inserted, i.e., the pin is best driven into the openings in the cylindrical body. Other means, such as threading, may be used to retain the pivot pin in the body. However, the opening in each of the blades is slightly larger than the diameter of the pivot pin so that the blades freely rotate. In addition, unlike my first hunting point, the width of the elongated slot in the cylindrical body need no longer be sized as to frictionally compress the two blades against each other but, may be larger.

It is noted that when the hunting broadhead is assembled and the first forward ends of each blade brought together to form the point of the broadhead, the first stop of each blade is urged against the sides of the cylindrical body. In this configuration, the sharpened first side or edge of each blade is recessed in position behind the partially chamferred edge of the opposite blade such that if a person were to grab the forward point or first end (at its sides) of each broadhead, their fingers come in contact with the two opposite partially chamferred edges and not the sharpened edges. The point of the resulting broadhead is also formed from two partially chamferred edges on each blade. The rubber band may be installed upon the hunting broadhead by slipping it down over the forward 60 percent or so length of the broadhead to stop at the base of each spur. In slipping the rubber band down over the broadhead, the band only engages the partially chamferred edges and is thus not severed.

The feature of utilizing the partially chamferred edge on one side of each blade and recessing the sharpened edge back behind the partially chamferred edge of the opposite blade (when assembled) provides an obvious safety measure in that the operator's fingers never come in contact with the sharpened edge so long as the hunting broadhead is handled in its forward 60 percent of its length or so. Additionally, if the animal which is shot has caked dirt or mud on its side, and this is very common, or if the animal's hide is very tough, the sharpened edges of the blades never directly engage the mud, hair, hide, or ribs or initial impact of the animal. Thus they are protected against dulling during entry into the animal and prior to each blade beginning its pivotal action to form the widened "V" configuration whereby the sharpened edge is placed forward. This pivotal operation commences after approximately 60 percent of the broadhead has entered the body of the animal's body and is completed entirely within the body cavity.

After entry, when the two blades rotate to open, the blades reach a point where the second stop of each blade engages the side of the cylindrical body at which time the blades form a common sharpened point of a widened "V" configuration. This point is formed by the right angle boots previously spoken of. As the hunting point continues along through the animal body, the rubber band may roll off each blade along its spur and end up residing on the arrow shaft or may be cut depending upon the hardness of the animal part interacting with the broadhead.

To withdraw the hunting broadhead from a game animal, the hunter grasps the arrow shaft and pulls backwardly. This causes the sharpened blades to rotate back to their initial flight position and present minimum resistance to the withdrawal of the arrow shaft and attached broadhead.

The advantage of providing one edge highly sharpened for cutting and the other edge partially chamferred for exposure at all other times provides great benefits in the subject hunting broadheads.

Accordingly, it is an object of the subject invention to provide a hunting broadhead which presents a relatively small sharp end or projection with minimum cross-section designed to penetrate the hide of the game animal but which, upon travel through the game, expands to provide a very sharp cutting edge to kill the animal in the most humane way possible. By such means, energy is not wasted in making a large surface entry opening.

It is another object of the subject invention to provide a hunting point which is most efficient and provides that the blades making up the hunting point metamorphoses from a relatively sharpened narrow point to a broad cutting inverted "V" sharpened formation.

It is still a further object of the subject invention to provide a hunting broadhead without a forward cylindrical body leading the arrow shaft into the game animal.

It is still further an object of the subject invention to provide a hunting broadhead which provides non-sharp partially chamferred edges for handling by the hunter so as to prevent cutting injuries to the hunter when using the hunting broadhead.

It is still a further object of the subject invention to provide a hunting broadhead having sharpened cutting edges which are protected against dulling prior to their designed time for cutting internally into the game animal.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein.

In various views like index numbers refer to like elements.

DETAILED DESCRIPTION OF THE PREFERRED EMBODIMENT

Figure 1:
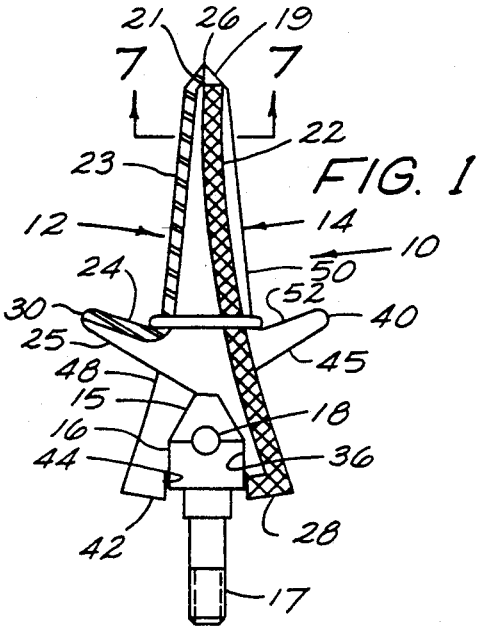
FIG. 1. is a top view of the subject hunting broadhead in a stored and in-flight configuration.

Referring now to FIG. 1, a top view of the subject inventive hunting broadhead is shown apart from an arrow shaft. Firstly, hunting broadhead 10 is made up of two elongated flat metal blades, namely first blade 12 and second blade 14, the blades so oriented that they lay or are juxtaposed one upon another with the back sides of the blades touching each other.

Blades 12 and 14 are situated within an elongated slot (not shown) formed in solid cylindrical body 16 so that they will, at the proper time, rotate about pivot pin 18 attached to cylindrical body 16 and pass transversely across its slot. However, the two blades are secured together in a closed position by an elastic or rubber band 20 (or they may be tied together with string), band 20 urging each of the blades' first stop (36 and 44) located at the rear or bottom of each of the blades against cylindrical body 16 whereby rotation in the direction normally urged by the rubber band upon each blade is terminated. As shown in FIG. 1, the blades overlap, but not completely, in that, by judicious recession of a substantial portion of the length of each blade's sharpened edge behind the opposite blade's partially chamferred or beveled edge, great safety benefits are provided. Other benefits provided are discussed later.

Also as seen in FIG.1, cylindrical body 16 is terminated in threaded shaft 17 adapted to be engaged by the threaded female opening of an arrow shaft (not shown).

Elongated first blade 12, which front or top face is shown, comprises a thin flat piece of high quality steel, preferably having a thickness of about 0.050 inch, an overall length of approximately 2½ inches, and a width of approximately 1 inch (including the protruding spur). Blade 12 has the top flat face of its right hand side (first side) peripheral edge 22 ground off to form a razor sharp edge which traverses substantially the length of the blade. All sharpened edges are preferably formed this way. In the preferred embodiment, peripheral edge 22 is slightly arcuate or concave along its length. Peripheral edge 22 could, however, be straight.

The top end of the blade 12 is terminated in a point 26 and the bottom end with foot 28. At the top, joining sharpened peripheral edge 22 point 26 is angled edge 19 which is blunted by partially chamfering or beveling. When an edge is partially chamferred, only a portion of the right angle corner of the edge is knocked off (by preferably grinding) so that the right angle edge is present for approximately 15% of the blade thickness. Blunting of an edge may also be accomplished by rounding the edge.

At the bottom, foot 28 is formed by a blade 12 making substantially a right angle at its joiner with sharpened edge 22. Foot terminates on its other side in first stop 36. Along the bottom peripheral edge of foot 28, the edge is highly sharpened as it was along sharpened edge 22.

Opposite peripheral edge 22 and an the left hand side (second side) of blade 12, starting at the top, angled edge 21 intersects with previously discussed angled edge 19 to form point 26. Angled edge 21 is also a blunted partially chamferred peripheral edge. Next, blunted partially chamferred or beveled peripheral edge 23 recedes rearward from a second location along a substantially straight angled line from angled edge 21 diverging from first side 22 approximately 60 percent of the length of the blade 12 to a first location where it joins outstanding spur 30. Outwardly protruding spur 30 also has a forward portion, partially chamferred edge 24. Residing at the first location, i.e., intersection of the second side partially chamferred edge 23 and forward peripheral edge 24 of spur 30, is rubber band 20.

Proceeding rearward, outwardly protruding spur 30 falls off along its rearward portion towards the first side along square cut peripheral edge 25, which constitutes second stop 25 later discussed. Continuing, second stop 25 next joins a semi-circular outwardly producing extension (covered by cylindrical body 16) which accommodates an opening receiving pivot pin 18. After the semi-circular protrusion, the left hand edge joins first stop 36 shown resting against the cylindrical side of body 16. First stop 36 holds first blade 12 in the forward position in FIG. 1 as rubber band 20 urges first blade 12 and second blade 14 together. The first stop of each blade engage opposite sides of cylindrical body 16.

Shown beneath first blade 12 is second blade 14, the unmodified flat back or underside of blade 14 visible. Second blade 14 is a duplicate of first blade, being only reversed in position in cylindrical body 16 so that neither its sharpened peripheral edges nor partially chamferred edges may be seem in FIG. 1. The back side of partially chamferred second side peripheral edge 50 and a portion of sharpened peripheral edge 48 are shown.

Further, second blade 14 second side outwardly protruding spur 40 is detailed, the bottom or back side of its forward partially chamferred peripheral edge 52 shown. The bottom of second blade 14 first side's arcuate sharpened edge 48 is revealed emerging from below the straight partially chamferred edge 23 and spur 30 of first blade 12. Also seen in the back side of sharpened foot 42 and first stop 44. Again, in the position shown, first stop 44 of second blade 14 is urged against the side of cylindrical body 16.

The most forward point 46 (not shown) of second blade lies immediately beneath and is aligned with point 26 of first blade 12 and, like point 26 of first blade 12, is formed by the intersection of two partially chamferred edges. By reducing the sharpness of points 26 and 46 with partially chamferred edges, the safety features of the subject invention have been additionally enhanced as the point of broadhead 10 will be less likely to stick the person handling it. Nevertheless, points 26 and 46 are still sufficiently sharp that they will easily puncture the hide of the struck animal when delivered by the hunter's bow.

With rubber band 20 at the base of partially chamferred peripheral edge 23 of the second side of the first blade 12 at the same place on the second side of second blade 14, the two blades are held together with their first stops engaging cylindrical body 16 to place the blades in the forward pointed position with their respective front points overlapping.

In the forward approximately three-quarters of the length of broadhead 10, the sharpened edge of each blade is protected by being recessed back from a partially chamferred edge of the opposite blade. For example, right sharpened peripheral edge 22 of first blade 12 is recessed behind the partially chamferred edge 50 of second blade 14 from its joinder with angled edge 19 near point 26 to its emergence from behind second stop 45 below outstanding spur 40. It is also important to keep this sharpened blade protected until after it has entered the body of the animal since the hide of the animal or rib bones (or for that matter, dirt on the animal's hide) will dull the sharpened edge.

Similarly, sharpened edge 48 second blade 14 is similarly recessed away from the partially chamferred edge 23 of first blade 12. By such means, the hunter can handle the subject broadhead in the forward three-quarters of the broadhead without danger of cutting himself. Typically, sharpened blades utilized in broadheads are razor sharp.

Rubber band 20 then may be slipped over the blunted partially chamferred edges of the second sides of each of the overlapping blades to position itself at the base of the two partially chamferred forward edges 24 and 52 of spurs 30 and 40 without danger of being severed.

While a rubber od elastic band has been suggested to secure the two blades together, other means have also been used. For example, I have applied an adhesive between the two blades at or near the first end. Also, it is possible to place a dimple or detent in the blades at or near the first end whereupon a concave dimple of one blade would reside in a convex dimple of the other. Of course, the blades with detents would not be interchangeable and separate blades with detents in opposite directions would need be fashioned. In addition, not shown, but it is apparent that a spring clip may be fashioned which would secure the lower rear end portions of both blades in the closed position.

Figure 2:
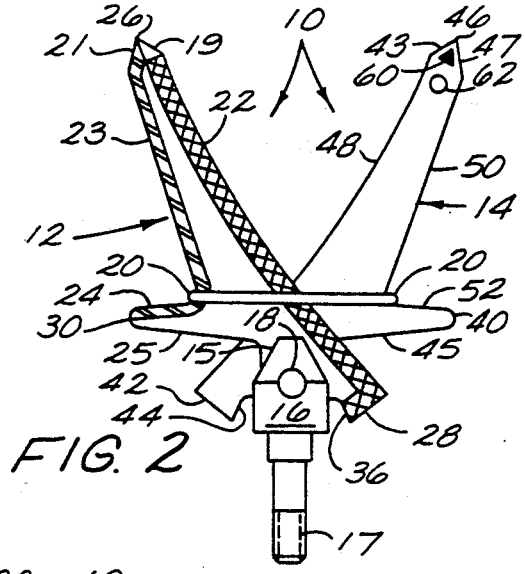
FIG. 2. is a top view of the subject hunting broadhead in a configuration after entering the game animal where the spurs have struck the animal hide or ribs and the blades have just started to rotationally separate.
Figure 3:
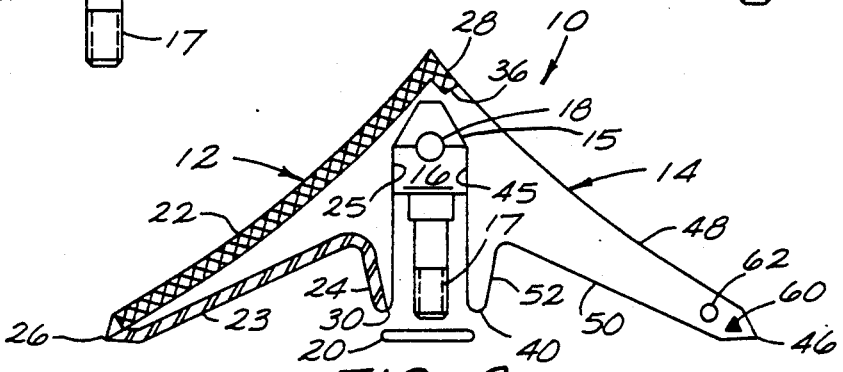
FIG. 3. is a top view of the subject hunting broadhead in its final inverted "V" configuration for travel internally to the game animal.

The configuration of broadhead 10 shown in FIG. 1 is the configuration of the blades during storage, during time of flight between the hunter's bow and the game animal, and during the initial penetration of the game animal. When penetrating the game animal, the two blades continue to stay together until the broadhead has penetrated to a depth such that the hide of the animal engages the forward partially chamferred peripheral edges 24 and 54 of the spurs 30 and 40 respectively. On most occasions, the animal will be struck in the rib cage area and the ribs immediately beneath the animal's hide will be engaged by the spurs. At that time, each blade begins to rotate about pivot pin 18 to begin opening of the two blades as shown in FIGS. 2 and 3.

As previously indicated, in my prior application, I depended upon friction between the backsides of the blades caused by carefully sizing the width of the elongated slot in the cylindrical body to tightly compress the blades to keep the blades in the closed position during storage, flight of the hunting point, and initial penetration of the animal. Also, during first few inches of penetration of the animal, the forward point of each blade was so shaped that pressing of the flesh and internal organs against the left hand angled edge which substantially made up the point, together with a slightly less angled left hand portion of each blade extending from near the point to the rear spur, continually urged the first stop of each blade against the cylindrical body and thereby kept the blades together.

This is not to say that a frictional relationship between the two blades to keep them together can not be utilized in my present invention, because it could. Such an embodiment would be obtained by carefully sizing the width of the slot in the cylindrical body.

In the embodiment of the subject invention, I no longer depend upon a frictional relationship between the blades or a left front angled side retreating from the point together to keep the blades together. Now I utilize a rubber band and a long extending angled straight left side to accomplish that feat. The angled sides situated immediately on each side of the point of the blade are almost symmetrical, although the left hand side is still slightly favored. Further, by my new design, the forward 60% or so of the blades have a thinner width for easier penetration.

In the process of modifying my original design, I have greatly enhanced the safety features to remove the sharpened edges away from the hunter's fingers well over three-quarters of the length of the broadhead as well as protecting the sharpened edges from dulling at all times prior to actual presence in the body cavity of the animal.

Referring now to FIG. 2, a top view of broadhead 10 is shown in a partially open configuration such as the broadhead might encounter just as its spurs have engaged the hide or ribs of a game animal and started rotation of each of the blades. Note that the rubber band is now being stretched as the blades open, the hitting force of the spurs against the hide or ribs of the game animal being sufficient to overcome the resistance of the rubber band holding the blades together. At this point, the forward portion of each of the blades is interiorly the body of the game animal and the hide or ribs of the animal are still restraining spurs 30 and 40 respectively. One additional advantage of having the forward edges of each of the spurs not razor sharp is that any tendency on the part of the blades to slice through the hide or the ribs and not open the blades is considerably lessened. At this point in time, the sharpened peripheral edges 22 and 48 of blades 12 and 14 respectively have begun to engage and cut the interior body of the animal between the two blades, which also helps to spread the blades. Additionally, animal flesh pressing against rubber band 20 may at this time cause it to be severed across partially chamferred edges 24 and/or 52.

A more revealing picture of the back or underside of second blade 14 is seen in FIG. 2, this side showing the flatness of the blade and the lack of sharpened or partially chamferred edges. It is of course realized that the peripheral sharpened edges 22 and 48 could be formed by taking equal amounts of metal off both sides of the blade to achieve a razor sharp edge, however, for economy of manufacture, to construct the sharpened edge, only one side has metal removed. Also, if the blades are sharpened to a central "V", then opportunity is afforded for hair and hide to wedge between the flat surfaces of the blade. Similarly, the partially chamferred or beveled edges 23 and 50 (and others) might also be constructed by partially chamferring both the top and the bottom face to leave a flat ridge between the two chamfers (rather than a sharp cutting edge), however again, for economy of manufacture and to prevent material from being wedged between flat sides of the blades during penetration, metal was removed from only one side of the blade to achieve the partial chamfer or bevel.

As previously mentioned, alternate embodiments of the invention may include other means to keep the blades together, such as adhesive 60 shown at the first end of second blade 14. The adhesive used by the inventor was a silicone sealant. This adhesive was sufficiently strong enough to keep the blades together in flight, in penetration and initial movement into the animal, yet did not prevent the blades from separating when the spurs struck the animal's hide. The adhesive was applied by placing a small amount upon one blade end and then moving the blades together to allow it to adhere to both blades. Then the adhesive was allowed to harden. Excess adhesive which might ooze out between the blades was wiped off.

Also seen in FIG. 2 is a second embodiment, namely the dimple or detent 62 placed into each blade. On the second blade 14, the dimple is concave. First blade 12 has a convex shaped dimple or detent. (not shown) which is so aligned as to mate with dimple 62 when the blades are in the fully closed position. The interlocking dimple or detent arrangement similarly provides sufficient holding to keep the blades together until time for the blades to pivot apart.

Also seen in FIG. 2, first stop 36 of first blade 12 and first stop 44 of second blade 14 have now left their position abutting the circular sides of cylindrical body 16.

FIG. 3 shows broadhead 10 in its fully open position, that position assumed by blades 12 and 14 where both foots 28 and 42 (formerly at the bottom of each blade) now overlap with overlapping points formed from the intersection of elongated sharpened edges 22 and 48 with sharpened foots 28 and 42 respectively. Elongated cutting edges 22 and 48 of blades 12 and 14 now are in full array to humanely kill the animal. Each of the blades have rotated from their position shown in FIG. 2 until each of their respective second stops engaged the circular sides of cylindrical body 16. More particularly, second stop 25 of blade 12 and second stop 45 of blade 14 each fully engage cylindrical body 16 which keep the blades in position shown in FIG. 3 throughout the broadhead's travel interiorly of the animal.

It is noted at this point that rubber band 20 has now slipped from its position (if not severed) at the base of partially chamferred sides 23 and 50 of respective blades 12 and 14 along partially chamferred leading edges 24 and 45 of respective spurs 30 and 40. Even with rubber band 20 coming off, if it has not been severed and if desired, it may be retrieved and reused. It will remain upon the shaft of the arrow (not shown) when it comes off. The alternate means of holding the blades together prior to their opening are also shown, namely first alternate, a small amount of adhesive 60 and second alternate, a dimple or detent 62.

Figure 4:
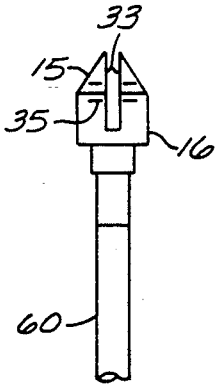
FIG. 4. is a side view of the cylindrical body of the invention.

FIG. 4 is a side view of solid cylindrical body 16 in which the two blades 12 and 14 reside. Firstly, cylindrical body 16 has a chamferred or beveled top conical surface 15 formed at its front so as to prevent undue opposition to its passage in the animal's interior. Cut parallel to the cylindrical axis of body 16 is elongated slot 33 in which resides the semi-circular protrusion of each of the two blades 12 and 14. These semi-circular protrusions are shown in FIGS. 6.A. and 6.B. infra. Shown also passing through cylindrical body 16 and at right angles to slot 33 is opening 35, opening 35 adapted to accommodate pivot pin 18 shown in FIG. 5 to secure the pivot pin across the slot. Since it is intended that pivot pin 18 shall frictionally reside in opening 35, the diameter of opening 35 should by only slightly less than the diameter of pivot pin 18 so that the pin may be driven in. Lastly, shaft of arrow 60 is shown attaching to the lower portion of cylindrical body 16, arrow shaft 60 having female threads formed in a blind cavity therein which mate with the male threads shown on the lower portion of cylindrical body 16 in FIGS. 1-3. Of course, other provision may be made for attaching the body 16 to an arrow shaft.

It is noted that in the subject invention, the width of slot 33 need not be tightly controlled as it was in my prior invention, subject of the above referenced patent application, since I no longer depend upon friction between the blades to keep the two blades together. Previously, the width of slot 33 was carefully cut to ensure that the two blades rubber each other sufficient friction therebetween that they would stay together during storage, flight, and initial penetration of the animal. Since I now depend upon a rubber band to keep the blades together, the width of slot 33 is no longer critical and the blades can fit more loosely therein.

Figure 5:
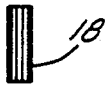
FIG. 5. is a side view of the pivot pin of the invention.

FIG. 5 is a side view of elongated, cylindrical pivot pin 18 which passes through the opening in each of the blades and is secured within opening 35 of cylindrical body 16.

Referring now to FIG. 6.A. and 6.B., a top or front view of each of the blades 12 and 14 is shown. As can be seen, each were constructed identical to the other to simplify manufacture. When mounted in the cylindrical body, they are placed with their flat uninterrupted back sides together.

Figure 6A:
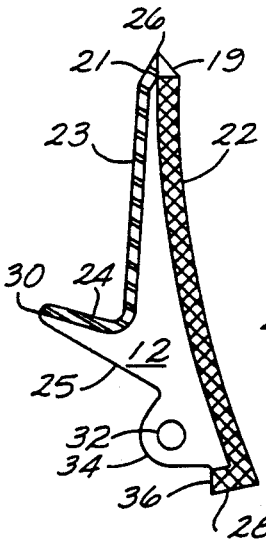
FIGS. 6.A. and 6.B. are top views of each of the blades which make up the invention.
Figure 6B:
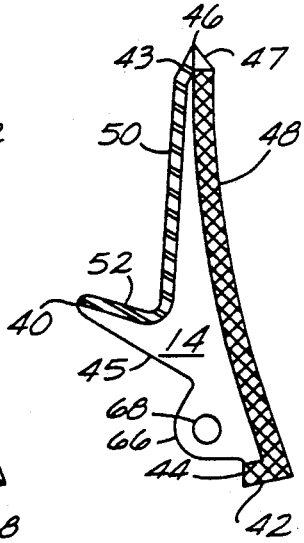

Commencing with FIG. 6*a*, at the very top is point 26 which is almost equally divided between angled sides 21 and 19 although in the preferred embodiment, left angled side 21 is slightly longer than right angled side 19. Both sides 21 and 19 have blunted partially chamferred edges so as not to present a sharp cutting edge. Point 26, however, is an angled point which has not been blunted as a point as it is formed by the two sides 21 and 19. Along the elongated right-hand or first side of blade 12, elongated peripheral edge 22 is sharpened from a second location at its joinder with angled side 19 wherein metal has been removed along the surface at the edge to meet the backside of blade 12 and achieve a razor sharp edge. Sharpened edge 22 is in the preferred embodiment slightly arcuate along its length, but may be straight providing it does not extend beyond the partially chamferred edge of the opposite blade when the unit is assembled and the blades fully overlapping. At the bottom end of blade 12 is sharpened foot edge 28, the angle made between the two sharpened edges 22 and 28 which became the front point in the configuration of FIG. 3, being just slightly less than a right angle.

On the opposite left hand or second side of blade 12 in FIG. 6.A. is blunted partially chamferred edge 23 which commences at the top second location connecting with left angled edge 21 and falls back in an angled substantially straight line diverging from the first side 22 to meet with spur at a first location. Along the forward peripheral edge of spur 30 is blunted partially chamferred edge 24, edge 24 at an acute angle to a longitudinal line drawn between point 26 and the center of opening 32. The angle of spur 30 to the longitudinal line referred to is shown at about 70 degrees. It may however be varied between 45 degrees and 90 degrees. Outwardly protruding spur 30 then falls off downwardly with second stop 25 angled towards sharpened edge 22, second stop 25 terminating at semi-circular protrusion 34, protrusion 34 having circular opening 32 formed in it. Opening 32, as earlier eluded to, receives pivot pin 18 shown in FIGS. 1–3 and 5 rotatably secure blade 12 to cylindrical body 16. Opening 32 is just slightly greater in diameter than pivot pin 18 so that while the blade will rotate easily, there is not excessive side-to-side movement.

Lastly, semi-circular protrusion 34 joins with first stop 36, stop 36 defining one side of sharpened foot 28. Both first stop 36 and second stop 25 provides limits to the rotation of blade 12 within cylindrical body 16, first stop 36 serving to define broadhead 10 in a position with penetrating point 26 forward of cylindrical body 16 for partial penetration of the animal and second stop 25 serving to define the position of broadhead 10 in its fully widened inverted "V" configuration cutting position.

FIG. 6.B. is a top view of second blade 14 (turned over from the view seen in FIGS. 1–3) to reveal its top or front side. It has forward most point 46 formed in part by right hand or first side angled edge 47 joining with the first side elongated sharpened peripheral edge 48 which continues in a sweep to sharpened peripheral foot 42 at the bottom of blade 14. Like blade 12, left angled side 43 and right angled side 47 define point 46 and are blunted partially chamferred edges. Sharpened edge 48 is also slightly arcuate (or it could be straight under circumstances outlined above) and the angle it make with foot sharpened edge 42 is approximately 90 degrees. On the opposite or second side of blade 14 in its upper part is angled left hand edge 50, edge 50 falling substantially straight from left angled edge 43 to the forward peripheral edge 52 of protruding spur 40. Rearward of spur 40 is second stop 45 which falls off towards the first side edge 48 to join with semi-circular outwardly extending protrusion 66 encompassing circular opening 68, opening 68 adapted to accommodate pivot pin 18 when blade 14 is situated in slot 33 of cylindrical body 16. Lastly, semi-circular protrusion 66 then joins with first stop 44 immediately below, first stop 44 then forming one side of sharpened foot 42. Again, as was the case with identical blade 12, if a longitudinal line were to be drawn from point 46 through the center of opening 68, forward peripheral edge 52 of spur 40 would make an angle of approximately 70 degrees.

Figure 7:
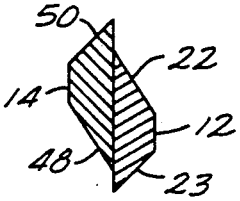
FIG. 7. is a sectional view of the hunting broadhead taken along lines 7—7 of FIG. 1.

Lastly, referring now to FIG. 7, a sectional view taken through the upper portions of blades 12 and 14 of FIG. 1 is shown. Here, the overlapping of the blades is more clearly seen to show the safety factor which has been built into the invention, namely that the sharpened edges are protected from coming in contact with the hunter's fingers when the broadhead is in the closed position, and that the blade is protected from dulling by recessing the sharpened edge behind the partially chamferred edge of the opposite blade. In FIG. 7, blade 12 is shown with its sharpened edge 22 recessed behind the partially chamferred edge 50 of blade 14. Similarly, sharpened edge 48 of blade 14 is recessed behind partially chamferred edge 23 of blade 12. In the preferred embodiment, the following are representative of the angles the surfaces make, for example, sharpened edges (22 and 48) are 30 degree angles and partially chamferred edges (23 and 50) are 45 degree angles, both angled relative to the flat top of bottom of the blades. As indicated earlier, the partially chamferred edge constitutes about 85% of the thickness of the blade and the right angle cut portion occupies about 15% of the thickness of the blade. This, of course, may be varied. In this configuration, so long as the blades are in the closed position shown in FIG. 1, the hunter may grab the tip of the broadhead without concern of being cut. Also, rubber band 20 may be pushed down over the two blades shown in FIG. 1 without being cut as it slides over the partially chamferred edges.

While a preferred embodiment of the invention has been shown and described, it is appreciated that other embodiments of the invention are possible and that there is no intent to limit the invention by such disclosure, but rather, it is intended to cover all modifications and alternate embodiments falling within the spirit and scope of the invention as defined in the appended claims.

I claim:

1. A hunting broadhead for attachment to an arrow used in bow hunting of a game animal which has a pointed end for flight, for penetration of the animal's hide, and for initial movement into the animal thereafter metamorphosing into a sharpened wide "V" configuration for continued movement through the animal, said hunting broadhead comprising:

a body adapted to be attached to the arrow;

an elongated first blade having a first end and a second end, said first end terminating in a point, and a spaced apart first side and second side each having a length running from said first end to said second end, said second side having an outstanding spur with a forward portion and a rearward portion, said first side having a sharpened edge from a second location near but behind said point to said second end and said second side having a blunted edge from said first end to and including said spur forward portion, said first and second side edge converging towards each other from a first location adjacent said spur to said second location, said second side edge being angled towards said first side edge from said second location and extending to meet said first side edge at said point, said first blade pivotally attached to said body proximate said second end;

an elongated second blade having a first end and a second end, said first end terminating in a point, and a spaced apart first side and second side each having a length running from said first end to said second end, said second side having an outstanding spur with a forward portion and a rearward portion, said first side having a sharpened edge from a second location near but behind said point to said second end and said second side having a blunted edge from said first end to and including said spur forward portion, said first and second side edge converging towards each other from a first location adjacent said spur to said second location, said second side edge being angled towards said first side edge from said second location and extending to meet said first side edge at said point, said second blade pivotally attached to said body proximate said second end;

said first and second blade being pivotal to and extending forward of said body in an orientation such that said blunted side edge of said first blade is on opposite sides from said blunted side edge of said second blade; and means securing said first and said second blade together to hold said first end of both said first blade and said second blade in an overlap configuration to form a single pointed end for flight with said blunted side edge of each said second side of each blade extending outwardly beyond said sharpened edge of each said first side from said first location to said second location, and said encompassing means together with said second blunted side wedge of both said first blade and second blade maintaining said first and second blade in a single point configuration during penetration and initial movement into the animal until said forward portion of each said spur engages the animal's hide to cause both said first and second blade to pivot about each said respective second end to present each said sharpened first side as a leading member in a sharpened wide "V" configuration for continued movement through the game animal for a clean kill.

2. The hunting broadhead as defined in claim 1 wherein said means securing said first and said second blade permits the pivoting of each said first and second blade upon each said spur engaging the animal's hide.

3. The hunting broadhead as defined in claim 2 wherein said securing means defines means tying said first and said second together in a closed pointed end configuration.

4. The hunting broadhead as defined in claim 2 wherein said securing means defines an elastic band encompassing both said first and said second blade to maintain the closed pointed end configuration.

5. The hunting broadhead as defined in claim 4 wherein said means securing said first and said second blade defines said elastic band situated at said first location of each said blade.

6. The hunting broadhead as defined in claim 2 wherein said securing means defines an adhesives situated between said first blade and said second blade.

7. The hunting broadhead as defined in claim 6 wherein said adhesive is situated proximate said first end of both said first blade and said second blade.

8. The hunting broadhead as defined in claim 2 wherein said means securing said first and second blade defines a concave detect in said second blade and a convex detent in said first blade whereupon said detects engage each other to hold said first blade and said second blade together in a closed pointed end configuration.

9. The hunting broadhead as defined in claim 8 wherein a detect securing means is situated proximate said first end of said first blade and said second blade.

10. The hunting broadhead as defined in claim 2 wherein said both said elongated first and second blade second end terminates in a right angle foot, said right angle foot of said first blade and said second blade overlapping to form a leading sharpened point of the sharpened wide "V" configuration for further movement through the game animal.

11. The hunting broadhead as defined in claim 10 further including a first stop formed in each said second side of said first blade and said second blade proximate said second end, each said first stop engaging said body when said first blade and said second blade first end overlaps in the single pointed end configuration.

12. The hunting broadhead as defined in claim 11 further including a second stop formed in each said second side of said first blade and said second blade proximate said spur rearward portion, said second stop engaging said body to maintain said first blade and said second blade in the sharpened wide "V" configuration for continued movement through the animal.

13. The hunting broadhead as defined in claim 12 wherein said body defines a cylindrical body which includes a slot and a pivot pin, said pivot pin transverse to and crossing said slot, both said first blade and said second blade partially residing in said slot and pivoting about said pivot pin.

* * * * *